US005649464A

United States Patent [19]

Gracey

[11] Patent Number: 5,649,464

[45] Date of Patent: Jul. 22, 1997

[54] PRIMER POCKET REAMER UNIFORMER

[76] Inventor: Doyle D. Gracey, P.O. Box 155, Tehachapi, Calif. 93581

[21] Appl. No.: 675,915

[22] Filed: Jul. 5, 1996

[51] Int. Cl.[6] ..... F42B 33/10

[52] U.S. Cl. ..... 86/36; 86/1.1; 86/23; 29/1.31; 29/1.32; 408/72 R; 408/87; 408/224

[58] Field of Search ..... 86/1.1, 23, 24, 86/32, 33, 36, 37, 38; 408/72 R, 87, 104, 224; 29/1.3, 1.31, 1.32

[56] References Cited

U.S. PATENT DOCUMENTS

| | | | |
|---|---|---|---|
| 2,443,807 | 6/1948 | Smiley | 29/1.32 |
| 2,977,618 | 4/1961 | Brisbin | 29/1.3 |
| 4,163,410 | 8/1979 | Dillon | 86/23 |
| 4,405,269 | 9/1983 | Hertzler | 408/211 |
| 4,742,606 | 5/1988 | Burby et al. | 29/1.32 |
| 5,050,475 | 9/1991 | Kolmer | 86/23 |
| 5,200,371 | 4/1993 | Doyle | 86/24 |

*Primary Examiner*—Harold J. Tudor
*Attorney, Agent, or Firm*—Kenneth G. Pritchard

[57] ABSTRACT

A primer pocket reamer for cartridge cases makes three distinct cuts for removing stake rings, chamfering the outer edge of a primer pocket and endmilling the bottom in a single process. This is accomplished by a cutter with three different rotating cutting edges. The cartridge case is brought to the cutter.

7 Claims, 2 Drawing Sheets

PRIMER POCKET REAMER UNIFORMER

BACKGROUND OF THE INVENTION

1. Field of the Invention

This invention relates to devices which permit reuse of spent cartridge cases by reforming the primer pocket. Specifically, this invention pertains to devices which ream primer pockets on spent cartridge cases.

2. Description of the Prior Art

A significant obstacle to reusing spent cartridge cases is the ability to reform the primer pocket. Some primer pockets have a stake which is a ring around the primer pocket. This stake is formed when the cartridge case is punched to assure a tight fit of the primer. This displaced metal makes the primer pocket walls taper rather than being straight. The opening is thus smaller than the bottom of the primer pocket. When a cartridge case is reused this taper makes it unsafe to refill the primer pocket as it was designed to function. Ideally, to load a primer pocket there should be a chamfer at the opening outward from the walls.

In the past a two step process has been used to first remove the stake usually by cutting or sometimes by forcing the metal back to its original position. This latter is known as swage. The second step is to clean up the sides and assure the bottom of the primer pocket is flat. Multiple steps make for a slow process of making spent cartridges available for reuse.

Accordingly, it is an object of the present invention to uniformly ream primer pockets on spent cartridges in a single process that leaves the primer pocket ready for reuse.

SUMMARY OF THE INVENTION

In the present invention a reamer has three distinct cutting surfaces, an end mill for assuring a flat bottom of the primer pocket, wall cutter to remove the stake, and a chamfer cutter to place a chamfer on the primer pocket. The cartridge case is brought to the cutter.

DESCRIPTION OF THE PREFERRED EMBODIMENT

Figure 1:
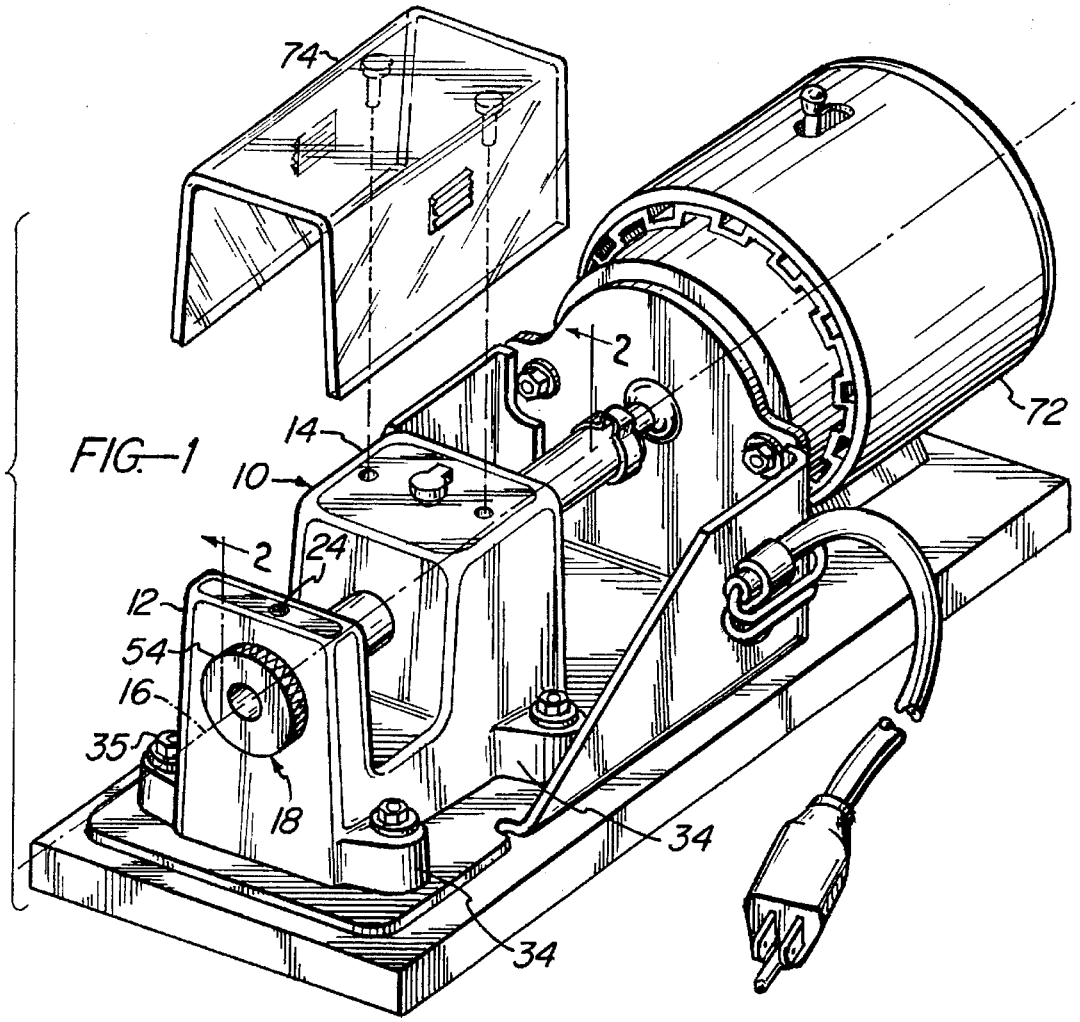
FIG. 1 is a perspective view of the present invention.

FIG. 1 shows a base 10, which may be a block of cast or machined metal such as aluminum. Attached to base 10 either by casting or other suitable means is a cartridge case holder housing 12 and a bearing housing 14 which are axially aligned with each other along axis 16 as shown. Within case holder housing 12, a case holder 18 is mounted. A set screw 24 may be used to lock case holder 18 in position. Within bearing housing 14, a bearing 26, not shown in FIG. 1, is mounted in any of the known ways to mount a bearing. Base 10 has ears 34 for bench bolts 35. Ears 34 may be shaped as desired. Bench bolts 35 allow base 10 to be rigidly mounted to a bench or other working platform. To this point everything is known prior art.

Figure 2:
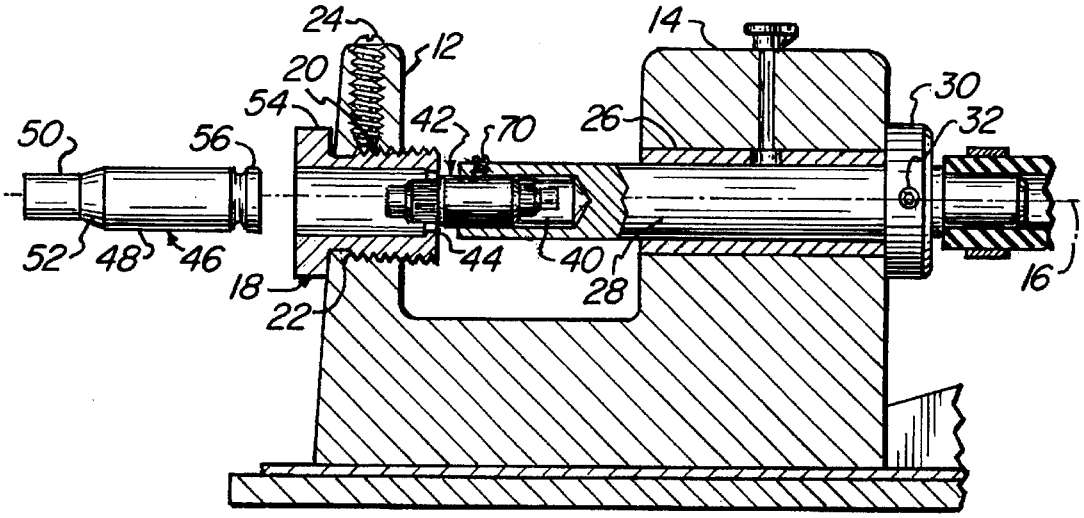
FIG. 2 is a cross sectional view of the present invention.

In FIG. 2 a cross sectional view of case holder 18 is shown. Threads 20 are shown on case holder 18 which are matched to threads 22 of case holder housing 12. Threads 20 and 22 permit case holder 18 to be set with great precision. In addition to mounting threads 20, a knurled surface grip 54, also shown in FIG. 1, may be added for ease in screwing case holder 18 into or out of case holder housing 12. A shaft 28 is mounted within bearing 26 and held in place by a shaft retainer 30 via a set screw 32, such that it is free to rotate. Shaft retainer 30 may be changed for any means for holding shaft 28 in place. As shaft 28 wears within bearing 26, adjusting shaft retainer 30 forward will maintain a snug fit. If shaft 28 is a harder substance than bearing 26, it is bearing 26 that wears away.

Shaft 28 has hollowed out end 40. Hollowed out end 40 holds cutter 42 by having an inside diameter that is equal to or slightly greater than the outside diameter of cutter 42.

Case holder 18 has stops 44 which limit the passage of anything whose diameter is the same or slightly smaller than the inside diameter of case holder 20. Cartridge case 46 has a main body 48, neck 50, and tapered surface 52. The bottom 56 of the cartridge case contains the primer pocket. Bottom 56 may also be described as the base of the cartridge case. When cartridge case 46 is inserted bottom 56 first into case holder 18 it is stopped by stops 44. Cutter 42 inserts into the primer pocket of bottom 56.

Figure 3:
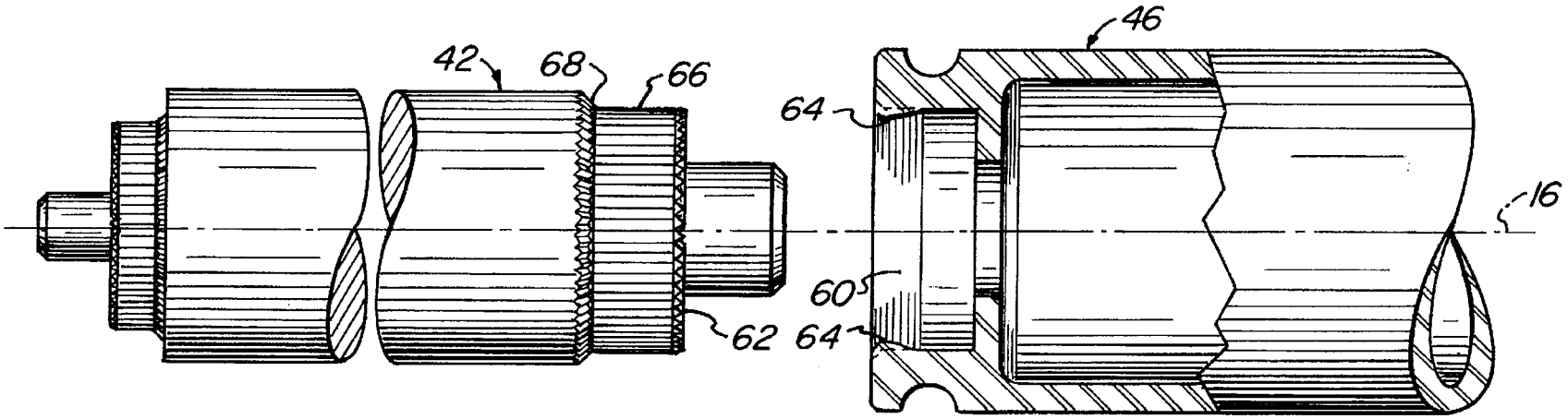
FIG. 3 is a side view of the cutter.

FIG. 3 shows how a primer pocket 60 of a cartridge case 46 fits over cutter 42. Surface 62 of cutter 46 is an end mill which is known in the art to assure flat bottoms. The stake ring 64 is shown on cartridge 46. Stake ring 64 shows the taper to walls that causes problems. Cutter 42 has a cutting edge 66 which removes stake ring 64 as cutter 42 is inserted into primer pocket 60. A chamfer cutting edge 68 then cuts a chamfer into primer pocket 60 as end mill 62 is assuring a flat bottom. Because primer pockets only come in two sizes the opposite end of cutter 42 can be conformed with the same three cutting surfaces for the other size. Thus one cutter 42 can handle all primer pockets and would only need to be reversed in hollow shaft end 40 as shown above. As shown in FIG. 2 a set screw 70 can hold cutter 42 in place.

Referring back to FIG. 1, shaft 78 is rotated either by a crank, not shown, or by a motor 72. Motor 72 may be any power drive. The void between bearing housing 14 and case holder housing 12 may be covered by a cover 74. Cover 74 prevents injury to users caused by small shavings of metal thrown by cutter 42.

What is claimed is:

1. A primer pocket reamer for cartridge cases compromising:

a base;

a bearing housing mounted to said base;

a shaft inserted into said bearing housing such that one end of said shaft extends from one side of said bearing housing and the other end of said shaft extends from the other side of said bearing housing with a hollow portion in said other end;

a case holder housing mounted to said base with an opening axially aligned with said shaft;

a cartridge case holder mounted within said case holder housing and axially aligned around said inserted shaft and with an opening shaped to match said cartridge case's external dimensions and base stops to prevent said cartridge case from being able to pass beyond a preset distance;

means for turning said shaft coupled to said one end of said shaft a cutter mounted within said hollow end of said shaft and extending into the case holder, and having three different cutting edges such that when a cartridge case is inserted into said case holder, base first, said cutter while rotated by said turning means via said shaft cuts away stake rings, chamfers the primer pocket and end mills the primer pocket bottom.

2. A primer pocket reamer as described in claim 1 where said turning means is a motor.

3. A primer pocket reamer as described in claim 1 where said cutter further comprises having two ends each with three different cutting edges for stake rings, chamfer and end milling.

4. A primer pocket reamer as described in claim 1 further comprising a guard mounted over said cutter to catch any shavings thrown off by said cutter.

5. A primer pocket reamer as described in claim 2 further comprising a guard mounted over said cutter to catch any shavings thrown off by said cutter.

6. A primer pocket reamer as described in claim 3 further comprising a guard mounted over said cutter to catch any shavings thrown off by said cutter.

7. A primer pocket reamer as described in claim 6 where said turning means is a motor.

* * * * *